US007372210B2

(12) United States Patent
Scolaro et al.

(10) Patent No.: US 7,372,210 B2
(45) Date of Patent: May 13, 2008

(54) METHOD AND APPARATUS FOR LAMP HEAT CONTROL

(75) Inventors: Martin S. Scolaro, Burlington, WI (US); Anil P. Ghode, Libertyville, IL (US)

(73) Assignee: Snap-on Incorporated, Kenosha, WI (US)

( * ) Notice: Subject to any disclaimer, the term of this patent is extended or adjusted under 35 U.S.C. 154(b) by 555 days.

(21) Appl. No.: 10/677,077

(22) Filed: Oct. 1, 2003

(65) Prior Publication Data

US 2005/0225256 A1 Oct. 13, 2005

(51) Int. Cl.
*H05B 37/02* (2006.01)

(52) U.S. Cl. ..... 315/209 R; 315/291; 315/224; 315/276; 315/360

(58) Field of Classification Search ..... 315/291, 315/247, 309, 157, 307, 219, 224, DIG. 4, 315/209 R, 77, 78, 82, 158, 208, 151, 360, 315/311
See application file for complete search history.

(56) References Cited

U.S. PATENT DOCUMENTS 3,697,863 A 10/1972 Kilner
3,846,674 A 11/1974 McNulty
4,137,484 A * 1/1979 Osteen ..... 315/209 R
4,682,084 A 7/1987 Kuhnel et al.
4,686,428 A 8/1987 Kuhnel et al.
4,713,721 A 12/1987 Pelonis
4,862,013 A * 8/1989 Konopka ..... 327/538
4,868,459 A * 9/1989 Dennerlein et al. ..... 315/158
4,902,958 A * 2/1990 Cook, II ..... 323/282
4,904,903 A * 2/1990 Pacholok ..... 315/209 R
5,012,392 A * 4/1991 Hochstein ..... 362/4
5,015,921 A * 5/1991 Carlson et al. ..... 315/208
5,046,152 A * 9/1991 Bartscher ..... 315/307
5,293,077 A * 3/1994 Seki et al. ..... 307/10.8
5,365,151 A * 11/1994 Spiegel et al. ..... 315/209 R
5,418,435 A * 5/1995 Yamada ..... 315/308
5,748,428 A 5/1998 Kelley et al.
5,801,490 A 9/1998 Fai
5,821,700 A * 10/1998 Malvaso ..... 315/291
5,859,503 A 1/1999 Potrasz
5,894,200 A * 4/1999 Goodale et al. ..... 315/360
5,969,437 A * 10/1999 Foerster ..... 307/66
6,198,234 B1 * 3/2001 Henry ..... 315/291
6,201,357 B1 3/2001 Seiler et al.
6,259,215 B1 7/2001 Roman
6,262,542 B1 * 7/2001 Kim et al. ..... 315/224
6,307,330 B1 * 10/2001 So ..... 315/291

(Continued)

FOREIGN PATENT DOCUMENTS

JP 08-144622 * 6/1996

*Primary Examiner*—Douglas W. Owens
*Assistant Examiner*—Chuc Tran
(74) *Attorney, Agent, or Firm*—Seyfarth Shaw LLP

(57) ABSTRACT

A lamp drive circuit includes an electronic switch in series with the lamp and a source of DC voltage, a control input of the switch being pulse-width-modulated by a control circuit which includes a temperature-sensing circuit for reducing the pulse-width-modulation duty cycle when lamp temperature exceeds a predetermined temperature. The temperature-sensing circuit may include a thermal switch in series with one of two parallel-connected resistors in a timing circuit. Duty cycle may also be automatically adjusted in response to changes in the source voltage.

17 Claims, 1 Drawing Sheet

U.S. PATENT DOCUMENTS 6,414,860 B1 * 7/2002 Li ..... 363/49
6,504,315 B2 1/2003 Kim
6,580,059 B1 * 6/2003 Kanno ..... 219/486
6,677,710 B2 * 1/2004 Weedon ..... 315/77
6,690,121 B1 * 2/2004 Weindorf ..... 315/247
6,841,941 B2 * 1/2005 Kim et al. ..... 315/86
6,853,153 B2 * 2/2005 Gray ..... 315/291
6,876,157 B2 * 4/2005 Henry ..... 315/219
6,946,806 B1 * 9/2005 Choi ..... 315/291

* cited by examiner

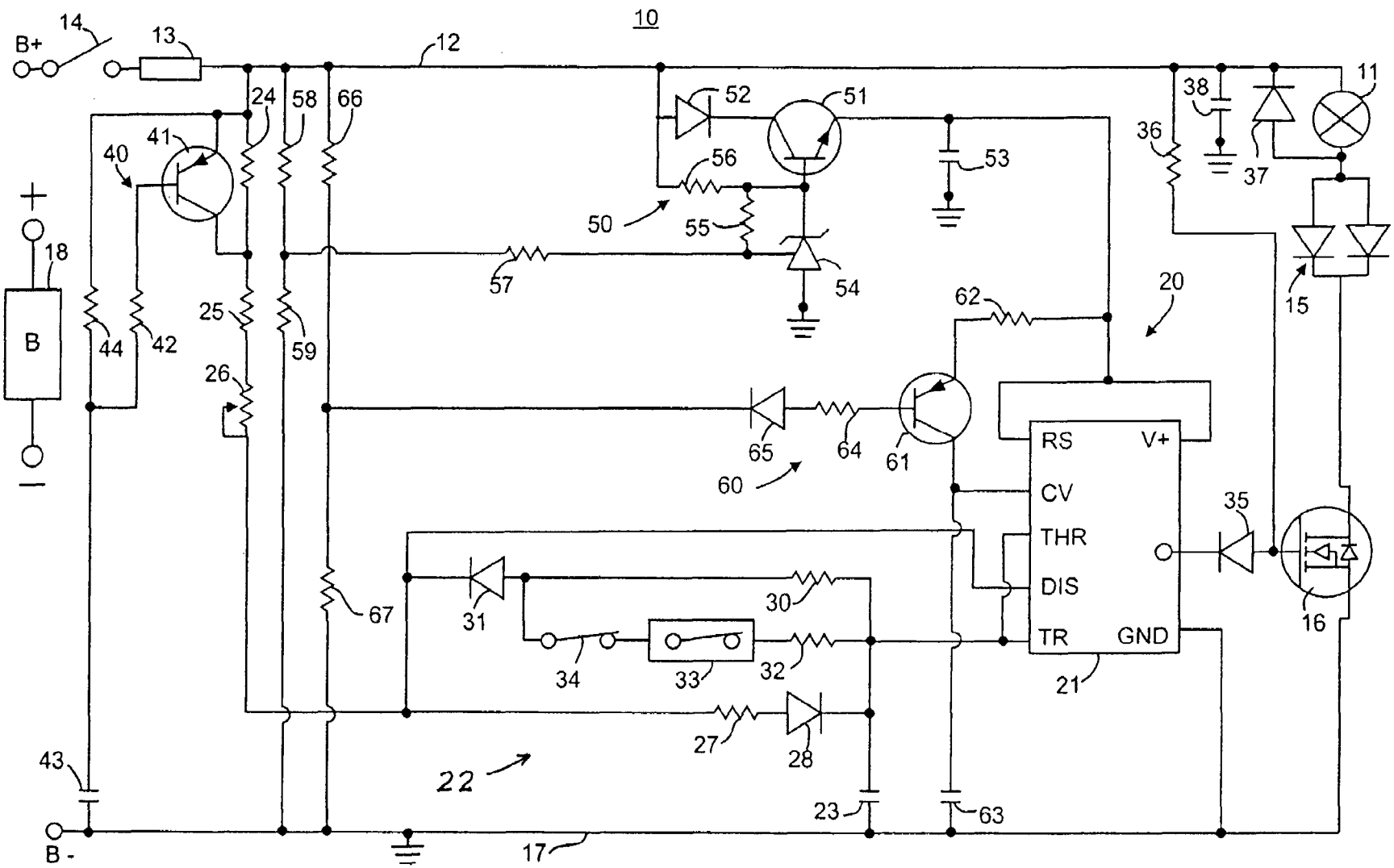
V+
GND
RS
CV
THR
DIS
TR
B+
B-
B

METHOD AND APPARATUS FOR LAMP HEAT CONTROL

BACKGROUND

This application relates to lamp drive circuits and has particular application to portable, battery-powered lamps, such as spotlights. In particular, the application deals with overheating protection for such lamps.

Many lamps, particularly high intensity lamps, including spotlights, can generate considerable heat in use. This heat may reach levels which create serious burn hazards to users, as well as risking damage to lamp components. Some lamps have user-selectable intensity or brightness controls which permit the lamp brightness level to be selectively reduced This could be useful when the lamp becomes excessively hot to the touch, but it is not of much use in protecting against overheating of lamp components, since the user typically has no way of knowing whether the temperature of the components has reached a dangerous level.

It is known to provide protection circuitry for lamps which is responsive to excessive temperature or current conditions to either turn off the lamp or reduce its brightness or intensity level to permit the lamp to cool. These devices commonly use thermistor-type dimming circuits or, in the case of high-intensity discharge lamps, may vary the lamp frequency. Also, such prior lamp drive circuits are typically designed for lamps powered by a fixed source voltage and operation of the lamp at other source voltages.

SUMMARY

There is disclosed in this application an improved lamp and drive circuit therefor, including an improved technique for providing overheating protection for such a lamp and drive circuit.

In particular there is disclosed an overheating protection technique for a pulse-width-modulated lamp.

In an embodiment, the technique is responsive to thermal sensing of the temperature of the lamp and/or drive circuit.

There is provided a technique which is effective with a variety of different DC source voltages.

In an embodiment, there is provided a drive circuit for a lamp comprising an electronic switch connectable in series with a lamp and a source of DC voltage and having a control input, and a pulse-width-modulation (PWM) control circuit having an input connectable to the source of DC voltage and an output connected to the control input of the electronic switch for varying lamp brightness in proportion to the PWM duty cycle, the control circuit including a temperature-sensing circuit for reducing the PWM duty cycle when lamp temperature exceeds a predetermined temperature.

There is also provided a lamp incorporating such a drive circuit. An embodiment also provides a method of protecting a lamp circuit from overheating, comprising pulse-width-modulating a supply voltage for controlling lamp brightness, sensing lamp temperature, and reducing the duty cycle of pulse width modulation in response to sensed temperature exceeding a predetermined temperature.

BRIEF DESCRIPTION OF THE DRAWINGS

For the purpose of facilitating an understanding of the subject matter sought to be protected, there is illustrated in the accompanying drawings an embodiment thereof, from an inspection of which, when considered in connection with the following description, the subject matter sought to be protected, its construction and operation, and many of its advantages should be readily understood and appreciated.

The FIGURE is a schematic circuit diagram of a lamp and drive circuit therefor.

DETAILED DESCRIPTION

Referring to the drawing, there is illustrated a lamp assembly, generally designated by the numeral 10, which may be in the nature of a portable spotlight adapted to be powered from a DC source. The lamp assembly 10 includes a lamp 11, which may be a quartz lamp, such as a six-volt, 55-watt lamp, having one terminal thereof connected to a B+ supply line 12 which is, in turn, connected through a fuse 13 and an ON-OFF switch 14 to a B+ input terminal. The switch 14 may be a manually-operable switch, such as a single-pole, single-throw switch. The other terminal of the lamp 11 is connected to the anodes of a pair of parallel-connected diodes 15, the cathodes of which are connected through a pulse-width-modulation (PWM) switch 16 to a B− supply line 17, which is connected to ground and to a B− input terminal. The switch 16 may be a MOSFET having its drain connected to the cathodes of the diodes 15 and its source connected to the B− line 17. The B+ and B− input terminals are adapted to be connected to the positive and negative terminals, respectively, of an associated supply battery 18, which may be a battery pack of the type utilized to power hand tools. The battery 18 may be of any of a number of different types, providing any of a variety of supply voltages, such as 9.6 volts, 12 volts, 14.4 volts and 18 volts, battery packs having these rated voltages being available from Snap-on Tools Company for powering a variety of different types of hand tools.

The lamp assembly 10 includes a drive circuit which includes a PWM control circuit 20, which may include an integrated circuit timer 21, such as an NE555P, configured as an astable multivibrator. The IC timer 21 is an 8-terminal device and its timing is controlled by an external timing circuit 22, which includes a capacitor 23 connected between the trigger terminal of the IC timer 21 and ground, the capacitor 23 being charged from the B+ supply line 12 through the series connection of a resistor 24, a resistor 25, a variable resistor 26, a resistor 27 and a diode 28, the cathode of which is connected to the trigger terminal of the IC timer 21. The timing circuit 22 also includes a resistor 30 connected to the trigger terminal of the IC timer 21 and also connected to the anode of a diode 31, the cathode of which is connected to the discharge terminal of the IC timer 21, which terminal is also connected to the junction between the variable resistor 26 and the resistor 27. Connected in parallel with the resistor 30 is the series combination of a resistor 32, a normally-closed thermal switch 33 and a selectively operable brightness control switch 34.

The output terminal of the IC timer 21 is connected to the cathode of a diode 35, the anode of which is connected to the gate or control input terminal of the MOSFET PWM switch 16, which gate terminal is also connected through a bias resistor 36 to the B+ supply line 12. A diode 37 is connected in parallel with the lamp 11, having its cathode connected to the B+ supply line 12, and a capacitor 38 is connected between the B+ supply line 12 and ground.

The drive circuit of the lamp assembly 10 includes a soft-start circuit 40, which includes a transistor 41, with its emitter-connector junction connected in parallel with the resistor 24. The base of the transistor 41 is connected through a resistor 42 to the junction between a capacitor 43 and a resistor 44 connected in series across the B+ and B− supply lines 12 and 17.

The control circuit 20 includes a supply voltage-dependent voltage regulator 50 for supplying a fixed regulated DC operating voltage to the IC timer 21, irrespective of the voltage of the supply battery 18. The voltage regulator 50 includes a transistor 51 having is collector connected to the base of a diode 52, the anode of which is connected to the B+ supply line 12. The emitter of the transistor 51 is connected through a capacitor 53 to ground and to the B+ and reset terminals of the IC timer 21. The base of the transistor 51 is connected to the cathode of an adjustable precision shunt regulator device, which functions essentially as a variable Zener diode, having its base connected to ground, and having a gate or control terminal connected to the B+ supply line 12 through series resistors 55 and 56, the junction between which is connected to the base of the transistor 51. The gate terminal of the shunt regulator 54 is also connected through a resistor 57 to the junction between voltage-dividing resistors 58 and 59 which are connected in series across the B+ and B− supply lines 12 and 17.

The control circuit 20 also includes a control voltage adjustment circuit 60, which includes a transistor 61 having its emitter connected through a resistor 62 to the output of the voltage regulator 50, and having its collector connected to the control voltage terminal of the IC timer 21 and through a capacitor 63 to ground. The base of the transistor 61 is connector through a resistor 64 to the anode of a diode 65, the cathode of which is connected to the junction between voltage-dividing resistors 66 and 67 which are connected in series across the B+ and B− supply lines 12 and 17.

In operation, when the lamp assembly input terminals B+ and B− are connected to a supply battery 18 of minimum voltage and the ON-OFF switch 14 is closed, the IC timer 21 outputs a PWM signal which turns the PWM switch 16 on and off at a predetermined rate for powering the lamp 11 at a brightness level which is proportional to the PWM duty cycle. The components of the timing circuit 22 may be selected so that the IC timer 21 operates at a frequency of about 100 Hz to approximate the operating conditions of a simple electronic transformer ballast of the type commonly used for quartz halogen lighting. The PWM duty cycle is determined by the timing circuit 22 and, in particular, by the charging and discharging rates of the capacitor 23, the IC timer 21 being ON when the capacitor 23 is charging and being OFF when the capacitor 23 is discharging. The capacitor 23 is charged through the series combination of the resistors 24 and 25, the variable resistor 26, the resistor 27 and the diode 28, and is discharged through the diode 31 and the resistance of the parallel circuit including the resistor 30, the resistor 32, the thermal switch 33 and the brightness control switch 34.

When both of the switches 33 and 34 are closed, the resistor 32 is connected in parallel with the resistor 30, and the duty cycle is at a maximum, resulting in maximum lamp intensity or brightness. If the sensed temperature of the lamp assembly 10 reaches a predetermined dangerous level, the thermal switch 33 opens to disconnect the resistor 32, thereby increasing the effective resistance of the parallel circuit and reducing the PWM duty cycle and, thereby, the brightness of the lamp. This reduced brightness level is maintained until the lamp cools sufficiently to reclose the thermal switch 33, whereupon the PWM duty cycle returns to its maximum level for driving the lamp 11 at its maximum brightness. The brightness level can be selectively reduced, irrespective of lamp temperature, by manually opening the brightness control switch 34 to remove the resistor 32 from the circuit.

It will be appreciated that, when the voltage of the supply battery 18 is increased, the lamp 11 would tend to burn even more brightly at its maximum brightness level, without appropriate adjustment. This adjustment is provided by the control voltage adjustment circuit 60. Normally, when the minimum supply battery voltage is applied, the transistor 61 is operating in a state of minimum conduction, being essentially an open circuit, providing a minimum voltage to the control voltage terminal of the IC timer 21, consistent with a maximum PWM duty cycle. As the voltage of the supply battery 18 increases, the voltage at the base of the transistor 61 from the voltage divider 66, 67 and the resistor 64 increases to increase conduction through the transistor to the control voltage terminal of the IC timer 21, for reducing the maximum PWM duty cycle and maintaining the brightness level of the lamp 11 at maximum PWM duty cycle at a substantially constant level, irrespective of the voltage of the supply battery 18.

The voltage regulator 50 serves to maintain the operating voltage supplied to the IC timer 21 at a constant regulated level, irrespective of the voltage of the supply battery 18. Thus, as the supply voltage increases, the voltage supply to the gate terminal of the shunt regulator 54 from the voltage divider 58, 59 and the resistor 57 increases to alter the conduction level of the transistor Q1 to a level necessary to maintain the constant regulated output voltage level supplied to the IC timer 21.

The soft-start circuit 40 operates in a known manner to gradually increase the impedance of the charging circuit for the timing capacitor 23 when the lamp assembly 10 is first powered up. Initially, when the ON-OFF switch 14 is closed, the resistor 24 is shorted by the transistor 41. As the capacitor 43 charges, the voltage at the base of the transistor 41 increases to gradually decrease is conduction until, when the capacitor 43 is fully charged, the transistor 41 is an open circuit.

Reverse battery protection is provided by the diodes 15 and 52 and the intrinsic circuit impedance. The diode 37 and the capacitor 38 are transient snubbers and the fuse 13 provides catastrophic failure protection.

In the illustrated embodiment, the lamp 1 is a quartz halogen lamp, but it will be appreciated that the operating principles of the control circuit 20 could be used with other types of lamps. Also, while in the illustrated embodiment the lamp assembly 10 constitutes a portable spotlight, it could be designed for other types of lighting applications. Also, it will be understood that the specific supply battery voltage levels indicated above are for purposes of illustration only and that other supply voltage levels could be utilized, with appropriate adjustments of component values.

From the foregoing, it can be seen that there has been provided an improved lamp assembly including a lamp and drive circuit therefor which are particularly adapted for PWM control of lamp operation, which provides overheating protection by thermal sensing of actual temperature of the lamp assembly to reduce the PWM duty cycle, and which automatically adjusts for operation with different DC supply voltage levels.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in

What is claimed is:

1. A drive circuit for a lamp comprising:

an electronic switch connected in series with a lamp and a source of DC voltage and having a control input terminal, and a pulse-width-modulation (PWM) control circuit having an input connectable to the source of DC voltage and an output connected to the control input terminal of the electronic switch for varying lamp brightness in proportion to the PWM duty cycle, the control circuit including a temperature-sense circuit for reducing the PWM duty cycle when lamp temperature exceeds a predetermined temperature.

2. The drive circuit of claim 1, wherein the control circuit includes a timing circuit and the temperature-sensing circuit includes impedance altering circuitry.

3. The drive circuit of claim 2, wherein the timing circuit includes an RC circuit and the impedance altered by the temperature-sensing circuit is in a capacitance discharge circuit.

4. The drive circuit of claim 2, wherein the impedance altering circuitry includes two resistances connected in parallel and a thermal switch in series with one of the resistances.

5. The drive circuit of claim 4, wherein the control circuit includes a selectively operable brightness control switch connected in series with the thermal switch.

6. The drive circuit of claim 1, and further comprising adjustment circuitry for automatically adjusting a control voltage of the control circuit in response to a change in the voltage-of the source.

7. The drive circuit of claim 6, wherein the adjustment circuitry includes a supply voltage-dependent voltage regulator for maintaining a constant operating voltage for the control circuit irrespective of the voltage of the source.

8. A portable spotlight comprising:

a lamp; and a drive circuit connected to the lamp, the drive circuit including an electronic switch connected in series with the lamp and a source of DC voltage and having a control input terminal, and a pulse-width-modulation (PWM) control circuit having an input connectable to the source of DC voltage and an output connected to the control input terminal of the electronic switch for varying lamp brightness in proportion to the PWM duty cycle, the control circuit including a temperature sensing circuit for reducing the PWM duty cycle when lamp temperature exceeds a predetermined temperature.

9. The spotlight of claim 8, Wherein the control circuit includes a timing circuit having two resistances connected in parallel, the temperature-sensing circuit including a thermal switch connected in series with one of the resistances.

10. The spotlight of claim 9, and hither comprising a selectly operable brightness control switch connected in series with the thermal switch.

11. The spotlight of claim 8, wherein the temperature-sensing circuit includes a thermal switch.

12. The spotlight of claim 8, wherein the control circuit includes an integrated circuit timer configured as an astable multivibrator.

13. A drive circuit for a lamp comprising:

electronic switch means connected to a lamp for controlling current flow through the lamp, from a DC source and having a control input terminal, and control means connected to the control input terminal of the switch means for pulse-width-modulation (PWM) of the switch means for varying lamp brightness in proportion to PWM duty cycle.

the control means including temperature-responsive means for reducing the PWM duty cycle when lamp temperature exceeds a predetermined temperature, wherein the temperature-responsive means includes thermal switch means.

14. A drive circuit for a lamp comprising:

electronic switch means connected to a lamp for controlling current flow through the lamp from a DC source and having a control input terminal, and control means connected to the control input terminal of the switch means for pulse-width-modulation (PWM) of the switch means for varying lamp brightness in proportion to PWM duty cycle.

the control means including temperature-responsive means for reducing the PWM duty cycle when lamp temperature exceeds a predetermined temperature, and adjustment means coupled to the control means for automatically adjusting the control voltage in response to changes in the voltage of the DC source.

15. A method of protecting a lamp circuit from overheating comprising:

pulse-width-modulating a supply voltage for controlling lamp brightness, sensing lamp circuit temperature, and reducing the duty cycle of pulse width modulation in response to a sensed temperature exceeding a predetermined temperature, the pulse-width-modulating including connecting an electronic switch in series with the lamp and pulse-width-modulating a signal at a control terminal of the switch.

16. A method of protecting a lamp circuit from overheating comprising:

pulse-width-modulating a supply voltage for controlling lamp brightness, sensing lamp circuit temperature, and reducing the duty cycle of pulse width modulation in response to a sensed temperature exceeding a predetermined temperature by altering a resistance in a timing circuit, wherein the altering resistance includes disconnecting one of two parallel-connected resistor.

17. A drive circuit for a lamp comprising:

an electronic switch galvanically connected in series with a lamp and a source of DC voltage and having a control input terminal, and a pulse-width-modulation (PWM) control circuit having an input connectable to the source of DC voltage and an output connected to the control input terminal of the electronic switch for varying lamp brightness in proportion to the PWM duty cycle, the control circuit including a temperature-sensing circuit for reducing the PWM duty cycle when lamp temperature exceeds a predetermined temperature.

* * * * *

UNITED STATES PATENT AND TRADEMARK OFFICE

CERTIFICATE OF CORRECTION

PATENT NO. : 7,372,210 B2
APPLICATION NO. : 10/677077
DATED : May 13, 2008
INVENTOR(S) : Martin S. Scolaro and Anil P. Ghode It is certified that error appears in the above-identified patent and that said Letters Patent is hereby corrected as shown below:

Column 5

Claim 10; line 58 "hither" should be --further--.

Claim 10; line 59 "selectly" should be --selectively--.

Signed and Sealed this

Fourteenth Day of October, 2008

JON W. DUDAS
*Director of the United States Patent and Trademark Office*